US007467734B2

(12) United States Patent
Bocola

(10) Patent No.: US 7,467,734 B2
(45) Date of Patent: Dec. 23, 2008

(54) VESSEL FOR PASTE AND CREAM PRODUCTS, SUCH AS COSMETIC, PHARMACEUTICAL PRODUCTS AND THE LIKE

(76) Inventor: Giovanni Bocola, Via Cavour 53, 20026 Novate Milanese (IT)

( * ) Notice: Subject to any disclaimer, the term of this patent is extended or adjusted under 35 U.S.C. 154(b) by 390 days.

(21) Appl. No.: 10/503,196

(22) PCT Filed: Feb. 4, 2003

(86) PCT No.: PCT/IT03/00052

§ 371 (c)(1),
(2), (4) Date: Jul. 30, 2004

(87) PCT Pub. No.: WO03/066475

PCT Pub. Date: Aug. 14, 2003

(65) Prior Publication Data

US 2006/0021998 A1 Feb. 2, 2006

(30) Foreign Application Priority Data

Feb. 4, 2002 (IT) ..... MI2002A0194

(51) Int. Cl.
*B65D 88/54* (2006.01)

(52) U.S. Cl. ..... 222/390; 222/546; 401/173

(58) Field of Classification Search ..... 222/390, 222/309, 310, 386, 387, 546; 401/172–175
See application file for complete search history.

(56) References Cited

U.S. PATENT DOCUMENTS

| | | | | |
|---|---|---|---|---|
| 3,325,063 | A | 6/1967 | Hansen | |
| 3,815,787 | A * | 6/1974 | Spies | 222/95 |
| 4,020,975 | A | 5/1977 | Stauffer | |
| 6,601,738 | B2 * | 8/2003 | Weigand et al. | 222/286 |
| 2003/0024949 | A1 * | 2/2003 | Garcia et al. | 222/103 |

FOREIGN PATENT DOCUMENTS

| | | |
|---|---|---|
| EP | 0 869 080 | 10/1988 |
| GB | 364 382 | 1/1932 |
| GB | 891102 | 3/1962 |
| GB | 2 304 825 | 3/1997 |

* cited by examiner

*Primary Examiner*—J. Casimer Jacyna
(74) *Attorney, Agent, or Firm*—James V. Costigan; Hedman & Costigan, P.C.

(57) ABSTRACT

The present invention relates to a vessel for paste and cream products in general, such as cosmetic, pharmaceutical products and the like, comprising a vessel outer body (1), defining a chamber (2) for holding the product to be delivered, the chamber being closed, on a side, by a ceiling (3) having a delivering hole (4) and, on the other side, by an ejecting piston (10) coupled to the outer body. Closure means for removably closing the product delivery hole being moreover provided.

2 Claims, 3 Drawing Sheets

VESSEL FOR PASTE AND CREAM PRODUCTS, SUCH AS COSMETIC, PHARMACEUTICAL PRODUCTS AND THE LIKE

BACKGROUND OF THE INVENTION

The present invention relates to a vessel for paste and cream products in general, such as cosmetic, pharmaceutical products and the like.

As is known, for delivering cream products are conventionally used vessels in the form of a tube, made by a lot of different making methods, said vessels allowing the product to be delivered by pressing or squeezing, and having, usually, the drawback that they does not allow a full delivery of the product held therein to be carried out.

Other prior solutions provide to use a rigid vessel, in which a pressure ejector is included, allowing the product to be properly delivered.

However, such an approach requires a comparatively high effort for delivering the product.

Because of the above mentioned reason, this solution has not been found as satisfactory by the user.

Moreover, all the above mentioned prior solutions, have the further drawback that they do not provide a proper thermal protection to the product, which, in a lot of cases, can be negatively affected by a high temperature change.

SUMMARY OF THE INVENTION

Accordingly, the aim of the present invention is to overcome the above mentioned drawbacks, by providing a vessel for paste and cream products in general, such as cosmetic, pharmaceutical products and the like, allowing to thermally preserving the product held therein, thereby preventing said product from being negatively affected.

Within the scope of the above mentioned aim, a main object of the present invention is to provide such a vessel allowing to deliver the paste or cream product without requiring any large effort, while allowing the product to be fully used or exhausted.

Another object of the present invention is to provide such a vessel including a product delivery hole which is properly protected thereby preventing the product from stagnating in contact with air.

Yet another object of the present invention is to provide such a vessel for paste product in general, such as cosmetic, pharmaceutical products and the like, which, owing to its specifically designed construction is very reliable and safe in operation.

According to one aspect of the present invention, the above mentioned aim and objects, as well as yet other objects, which will become more apparent hereinafter, are achieved by a vessel for paste products in general, such as cosmetic, pharmaceutical products, and the like, in cream form, characterized in that said vessel comprises a vessel outer body defining a chamber for holding the product to be delivered therein, said chamber being closed, on a side, by a ceiling having a product delivery hole and, on another side, by an ejecting piston, coupled to said vessel outer body, closure means for removably closing said product delivery hole being moreover provided.

BRIEF DESCRIPTION OF THE DRAWINGS

Further characteristics and advantages of the present invention will become more apparent hereinafter from the following detailed disclosure of a preferred, though not exclusive, embodiment of a vessel for paste products in general, such as cosmetic, pharmaceutical and the like products in cream form, which is illustrated, by way of an indicative, but not limitative, example in the accompanying drawings, where.

DESCRIPTION OF THE PREFERRED EMBODIMENTS

Figure 1:
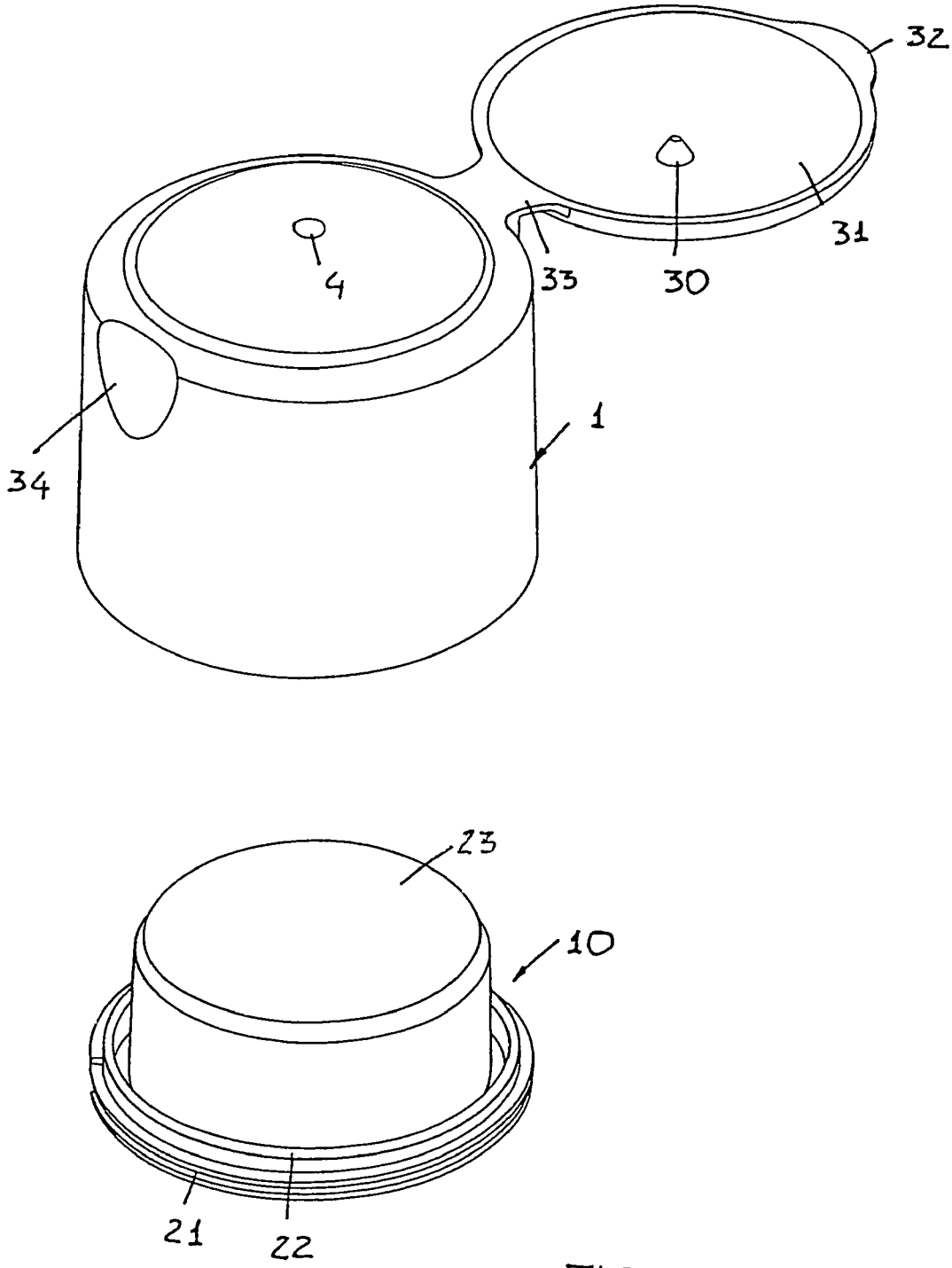
FIG. 1 is an exploded perspective view of the vessel according to the present invention.
Figure 2:
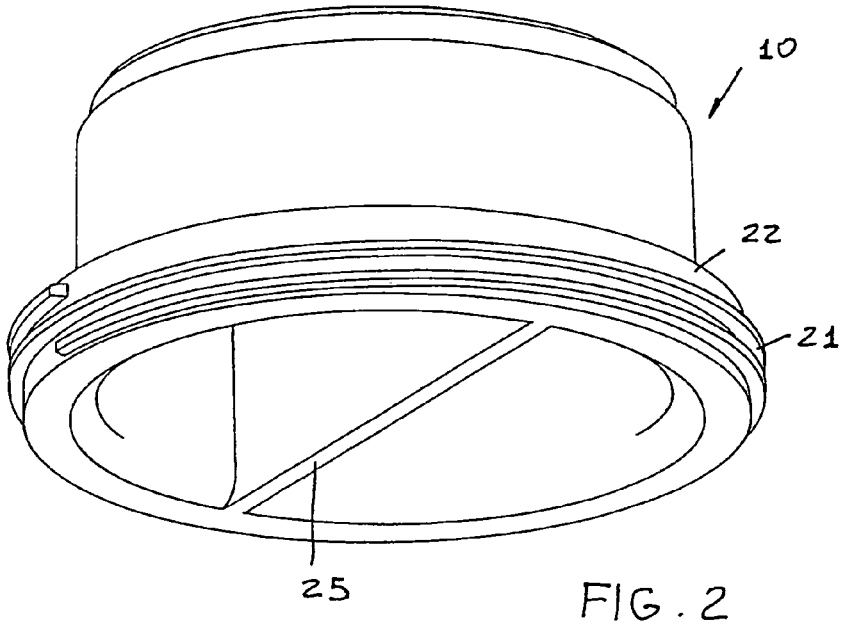
FIG. 2 is a further perspective view illustrating the ejecting piston included in the vessel according to the invention.
Figure 5:
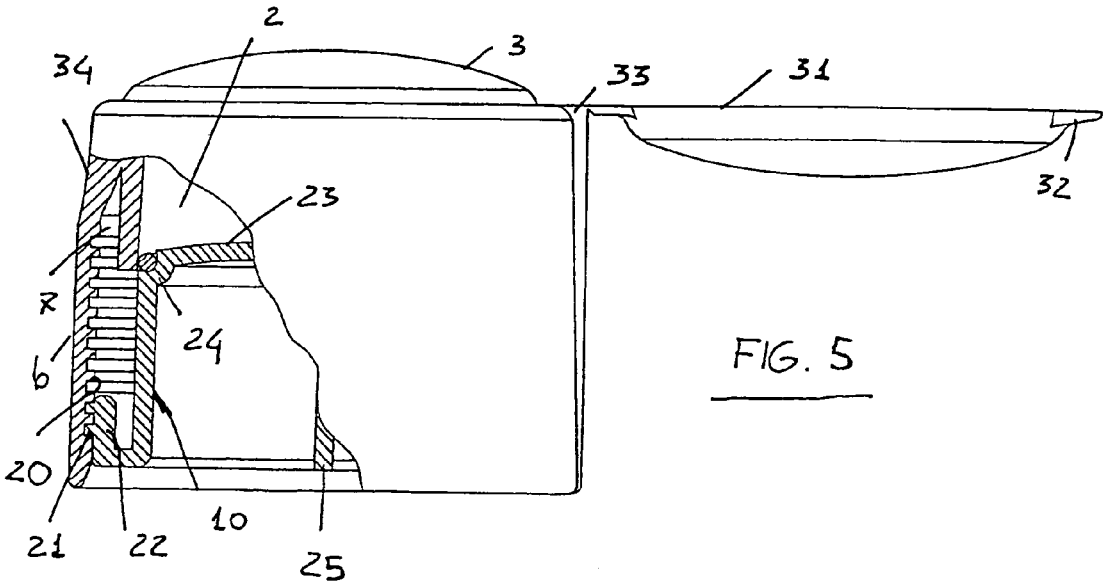
FIG. 5 illustrates a partially cross-sectioned view of the vessel according to the invention, in an open position thereof.
Figure 4:
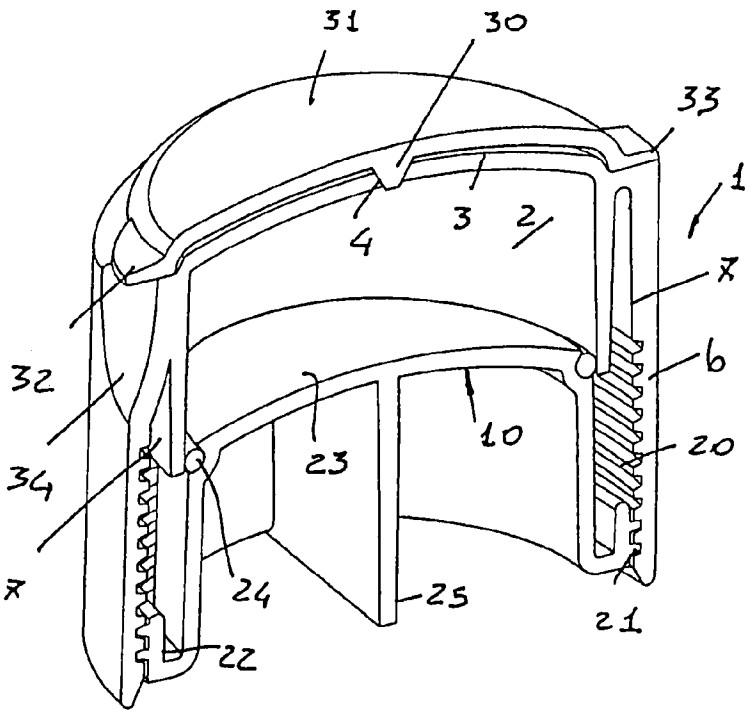
FIG. 4 illustrates a further diametrical cross-section view of the vessel according to the invention.
Figure 3:
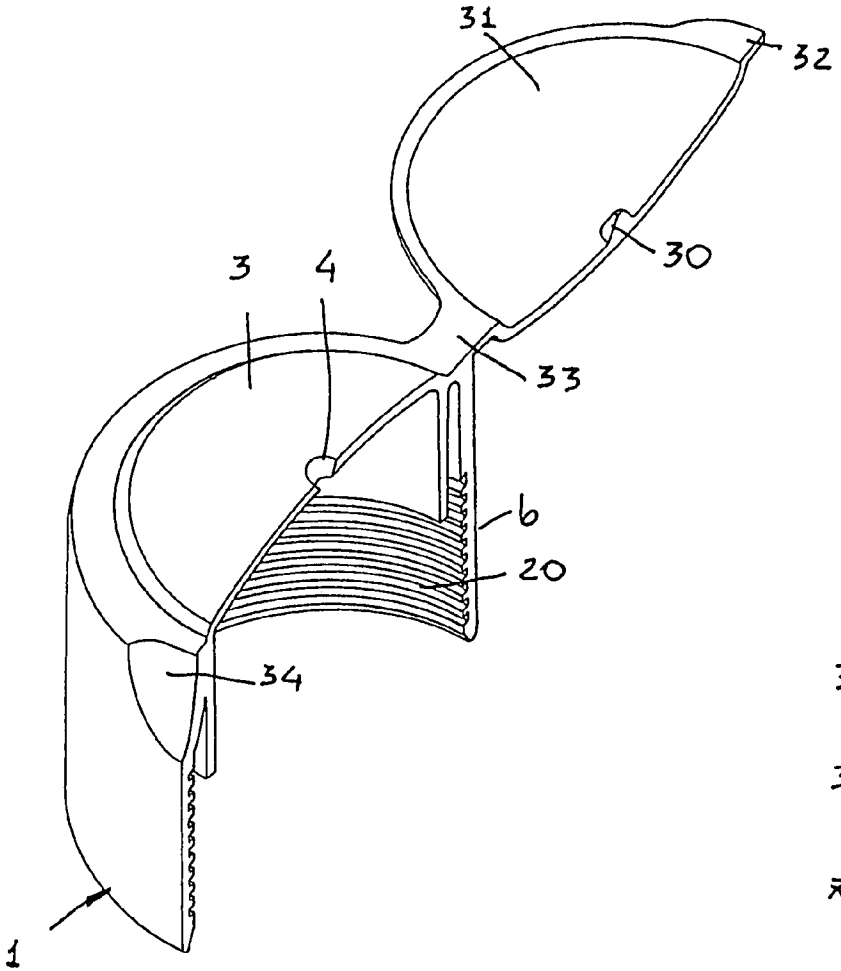
FIG. 3 illustrates the outer body of the vessel, as diametrically cross-sectioned.

With reference to the number references of the above mentioned figures, the vessel for paste products in general, such as cosmetic, pharmaceutical and the like products, according to the present invention, comprises a vessel outer body, generally indicated by the reference number 1, which defines an inner chamber 2 provided for holding therein the product to be delivered, said chamber being closed, at the top thereof, by a ceiling 3, provided with a central delivery hole 4 which, advantageously, has a substantially frustum of cone configuration.

At the bottom portion of said chamber an ejecting piston, generally indicated by the reference number 10 is provided, said ejecting piston being coupled to the vessel outer body 1, as it will become more apparent hereinafter.

The outer body 1 is provided with an outer mantle 6, which practically defines a gap 7 encompassing the chamber 2 and providing a thermal barrier.

Moreover, the outer mantle or shell 6 comprises, toward the open portion thereof, an inner thread 20, therewith engages an outer thread 21, formed on a bottom lip 22 of the ejecting piston.

The latter is provided, at the top thereof, with a bottom element 23 encompassed by a sealing gasket 24, operating on the side walls of the chamber 2, thereby providing a tight closure of said chamber.

Moreover, said piston comprises an integral bottom cross wall 25 transversely formed through a bottom cavity of said piston (see for example *Fig*. 2), which cross wall constitutes a handle element to be directly gripped by a user thereby allowing to rotatively drive the ejecting piston, upwardly in said chamber thereby gradually ejecting, as said piston is upwardly rotatively driven, said product held in said chamber 2 through the hole 4.

The delivery hole 4, in particular, can be advantageously closed by removable closure means, comprising a lug 30, formed on a closure cover element 31.

Said closure cover 31 can be mounted above the ceiling 3 and comprises a gripping projection or lug 32, diametrically arranged with respect to the pivot region 33, and at a nail recess 34 defined on the outer surface of the vessel outer body.

Accordingly, with the cover element 31 in a closure condition, the lug or projection 30 will be engaged in the frustum of cone shaped hole 4, thereby providing a perfect tight closure, and preventing the product to be delivered from contacting air.

Another important aspect of the present invention is that the mentioned gap 7 provides a thermal barrier, allowing the product to be perfectly preserved.

From the above disclosure it should be apparent that the invention fully achieves the intended aim and objects.

In particular, the vessel according to the present invention, in addition to providing a perfect preserving of the product, can be used in a very simple and easy manner, since the delivery of the product can be simply obtained by turning the ejecting piston, by exploiting the diametrical wall 25, with a consequent introduction of said ejecting piston into the chamber 2.

The invention, as disclosed, is susceptible to several modifications and variations, all of which will come within the scope of the invention.

Moreover, all the constructional details can be replaced by other technically equivalent elements.

In practicing the invention, the used materials, as well as the contingent size and shapes can be any, depending on requirements.

The invention claimed is:

1. A vessel for a paste and cream product, said vessel comprising a vessel outer body defining a product holding chamber for holding therein a product to be delivered, said chamber being closed, on a side, by a ceiling having a product delivery hole, said delivery hole being removably closed by closure means and, on the other side, by a product ejecting piston coupled to said vessel outer body, wherein said vessel outer body defines an outer mantle having an open end portion and forming a thermal barrier gap in cooperation with a wall delimiting said chamber, wherein said vessel comprises, at said open end portion of said mantle, an inner thread which can be engaged with an outer thread formed on a lip of said product ejecting piston, and wherein said piston comprises integral handle means formed on a surface of said piston adapted to be directly gripped by an user to rotatively drive said piston to cause said piston to move upward in said product holding chamber to directly contact and gradually eject said product from said product delivery hole.

2. A vessel for paste and cream products, said vessel comprising a vessel outer body defining a chamber for holding therein a product to be delivered, said chamber being closed, on a side, by a ceiling having a product delivery hole, said delivery hole being removably closed by closure means and, on the other side, by a product ejecting piston coupled to said vessel outer body, wherein said vessel outer body defines an outer mantle having an open end portion and forming a thermal barrier gap in cooperation with a wall delimiting said chamber, wherein said product ejecting piston comprises a bottom which is circumferentially encompassed by a sealing gasket, and wherein said integral handle means comprise a bottom integral cross wall formed through a bottom cavity of said piston and operating as a handle element to be gripped by a user for rotatively driving said piston, to upward displace said piston in said chamber thereby gradually ejecting said product from said delivery hole.

* * * * *